United States Patent [19]

Silcox

[11] Patent Number: 4,521,135

[45] Date of Patent: Jun. 4, 1985

[54] PRESSURIZED GAS FILLED TENDONS

[75] Inventor: William H. Silcox, San Francisco, Calif.

[73] Assignee: Chevron Research Company, San Francisco, Calif.

[21] Appl. No.: 508,743

[22] Filed: Jun. 28, 1983

[51] Int. Cl.[3] ..... E02B 17/00; B63B 35/44

[52] U.S. Cl. ..... 405/224; 405/195; 405/211; 114/265

[58] Field of Search ..... 405/224, 195, 225, 226, 405/227, 203–208; 114/264, 265

[56] References Cited

U.S. PATENT DOCUMENTS

| | | | |
|---|---|---|---|
| 3,472,062 | 10/1969 | Owen | 285/93 X |
| 3,517,517 | 6/1970 | Blenkarn | 405/225 |
| 3,884,511 | 5/1975 | Hermanson | 285/276 X |
| 3,907,336 | 9/1975 | Siegmund | 285/93 |
| 3,978,804 | 9/1976 | Beynet et al. | 405/224 |
| 4,116,044 | 9/1978 | Garrett | 285/93 X |
| 4,234,216 | 11/1980 | Swanson et al. | 285/93 |
| 4,285,615 | 8/1981 | Radd | 405/224 X |

*Primary Examiner*—Dennis L. Taylor

*Attorney, Agent, or Firm*—S. R. LaPaglia; E. J. Keeling; P. L. McGarrigle

[57] ABSTRACT

Pressurized gas filled tubular tendons provide a means for detecting leaks therein. Filling the tendon with a gaseous fluid provides increased buoyancy and reduces the weight supported by the buoyant structure. The use of a corrosion inhibiting gaseous fluid reduces the corrosion of the interior tendon wall.

20 Claims, 3 Drawing Figures

PRESSURIZED GAS FILLED TENDONS

INTRODUCTION

The present invention relates generally to tension leg platform tendons. More particularly, the present invention relates to pressurized gas filled tendons for detecting leaks, providing buoyancy and resisting corrosion. A change in pressure denotes a structural deficiency. An increase in tendon buoyancy reduces the weight supported by the buoyant structure. Corrosion resistance extends the useful life of the tendon.

BACKGROUND OF THE INVENTION

In deep water, the use of bottom-founded structures for oil well drilling and production operations is cost prohibitive due to the expense for fabrication and installation of such large structures. For water depths in excess of 1,000 feet, buoyant offshore structures moored to the sea floor can be used to perform drilling and production operations cost effectively.

As water depth exceeds 1,000 feet, the tension leg platform (TLP) concept can be introduced to perform oil drilling and production operations. A TLP consists of a buoyant offshore structure moored to fixed sea floor anchor points with vertical tension legs; also referred to as tendons. Drilling, producing and processing equipment as well as crew's quarters are contained in or on the buoyant offshore structure.

Tendon designs include both cable and tubular leg elements. U.S. Pat. No. 4,285,615, issued Aug. 25, 1981 to Fredrick J. Radd discloses, "A mooring apparatus for a structure floating on a body of water, comprising: a corrosion resistant cable system; including a multistrand cable, having voids between adjacent strands;". U.S. Pat. No. 4,226,555, issued Oct. 7, 1980 to Henry A. Bourne, Jr. discloses, "A mooring system for a tension leg platform, comprising: a tension leg, including a plurality of tubular leg elements having threaded connections between adjacent leg elements;".

The use of pre-tensioned vertical mooring elements prevents vertical motion but permits lateral motion of the floating structure during the passage of waves. Pretensioning is accomplished by deballasting the buoyant offshore structure after the tendons are connected between the buoyant structure and fixed sea floor anchor bases.

Tendon inspection is necessary as both a maintenance expenditure and safety precaution. Tendon repair and replacement are both very expensive and laborious operations. Cracks and corrosion due to exposure to sea water decrease the failure load and working lifetime of the tendon. The desirability of minimizing tendon corrosion has been recognized in the art. Previously cited U.S. Pat. No. 4,285,615 discloses an invention for providing a corrosion resistant design for a tension leg cable which isolates the steel wire cable from the sea water environment.

The present invention provides a method and means for detecting structural deficiencies in a tubular tendon, increasing its buoyancy and extending its useful life.

SUMMARY OF THE INVENTION

The present invention provides a method and means for detecting leaks in a tubular tendon, increasing its buoyancy and extending its useful life. A plurality of tendon segments, each consisting of a tubular element and sealable couplings, are joined to provide a single elongated tubular tendon. The tubular tendon is filled with a corrosion inhibiting gaseous fluid. A compressor is utilized to pressurize the contents of the tubular tendon and pressure gauges monitor variations in pressure.

The corrosion inhibiting gaseous fluid protects the interior tendon wall from salt water corrosion. The gaseous fluid increases the buoyancy of each tendon, thereby reducing the weight supported by the buoyant offshore structure. Variations in pressure indicate cracks or punctures through the tendon or an inadequate coupling seal.

PRINCIPAL OBJECT OF THE INVENTION

The object of the present invention is to provide a method and means for detecting leaks in a tubular tendon, increasing its buoyancy and extending its useful life. A method and means for detecting leaks indicating structural deficiencies promotes safety and reduces routine maintenance expenditures. Increasing the buoyancy of the tendon reduces the weight supported by the buoyant offshore structure; permitting a more efficient design. Increased tendon life provides more cost effective deep water drilling by reducing maintenance, repair and replacement of the tendons.

Another object of the present invention is to provide an improved design for a tension leg platform incorporating the invention described herein.

Additional objects and advantages of the present invention will become apparent from a detailed reading of the specification and drawings which are incorporated herein and made a part of this invention.

DESCRIPTION OF THE PREFERRED EMBODIMENT

Figure 1:
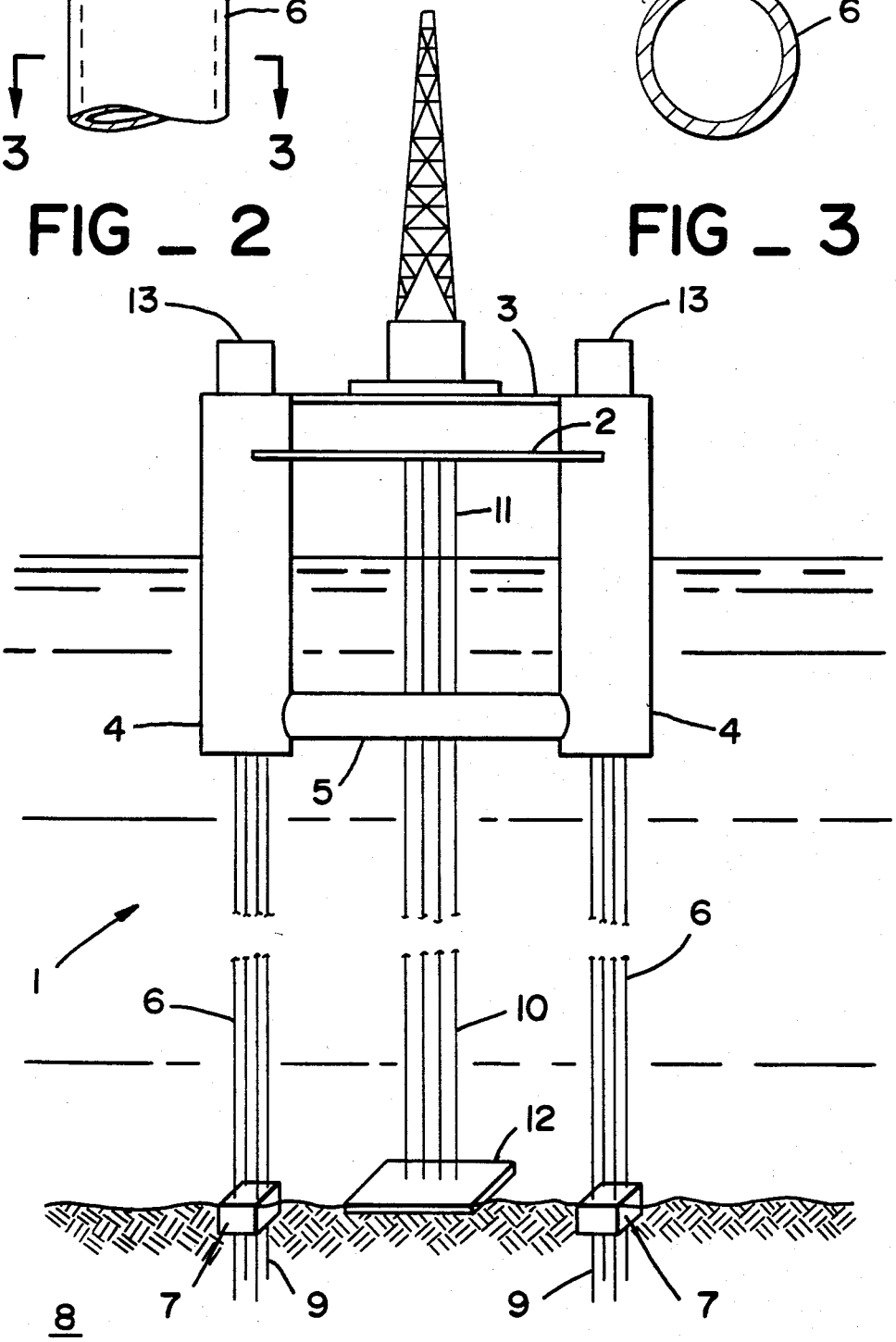
FIG. 1 is an elevation schematic view, partially in section, of a tension leg platform.

FIG. 1 shows an elevation schematic view, partially in section, of a tension leg platform (TLP) 1 deployed at a drilling site. A lower platform 2 is provided on which may be mounted crew's living quarters, well test equipment and processing equipment. An upper platform 3 is provided on which may be mounted a pilot house, cranes, the drilling derrick, skid base, the drill string and a helicopter landing site. Similar conveniences as are known to those skilled in the art of oil exploration and production may also be stored on the lower and upper platforms. Platforms 2 and 3 are supported by a plurality of annular support columns 4. When the TLP is in its illustrated buoyant condition, columns 4 and pontoons 5 extend beneath the surface of the water. A plurality of tendons 6 extend from each support column 4 to anchor means consisting of a foundation template 7 secured to the sea floor 8 with friction piles 9, thereby restricting movement of the structure. A drill string 10 and risers 11 extend from platform 1 or 2 between pontoons 5 to the sea floor 8 during drilling and producing operations. Well template 12 maintains the risers in a stationary position relative to the sea floor 8.

Figure 2:
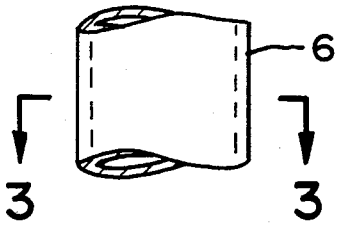
FIG. 2 is an enlarged detailed view of the tendon of FIG. 1.
Figure 3:
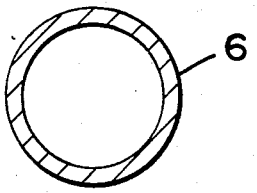
FIG. 3 is a section view of the tendon of FIG. 2 taken about line 3—3.

Referring to FIG. 2, an enlarged detailed view of tendon 6 depicts the tendon as a tubular element. A plurality of tendon segments, each consisting of a tubular element and sealable couplings, are joined to provide a single elongated tubular tendon. The tubular element typically has a relatively thin wall compared to its overall diameter. A tubular element has been designed utilizing inside and outside diameters of 18 and 20 inches, respectively. FIG. 3 shows a section view of the tendon of FIG. 2 taken along line 3—3.

In accordance with the present invention, corrosion inhibiting gaseous fluid enters the tendon through a conduit located at its upper end. Nitrogen or air is preferred.

Subsequent to the introduction of gaseous fluid to the tendon, compressor 13 supplies pressure through the conduit to the tendon's contents. A pressure in excess of the maximum hydrostatic pressure exerted by the sea water on the tendon is recommended to avoid the instance where the pressure inside the tendon is equal to the sea water pressure at the same elevation. A positive net internal pressure is utilized to detect a leak. A valve is closed to retain the pressurized contents. Pressure gauges monitor the pressure therein. Reductions in pressure, in excess of a predetermined value, activate a signal to inform crew members of a deficient tendon.

The corrosion inhibiting gaseous fluid protects the interior walls of the tubular tendon from exposure to sea water. The gaseous fluid provides buoyancy and reduces the tendon weight supported by the offshore buoyant structure. Barring any pressurizing malfunctions, a change in pressure indicates a leak in the tendon attributable to a crack or puncture through the tendon or an inadequate coupling seal.

While a certain preferred embodiment has been specifically disclosed, it should be understood that the invention is not limited thereto, as many variations will be readily apparent to those skilled in the art and the invention is to be given its broadest possible interpretation within the terms of the following claims.

What is claimed is:

1. Apparatus for detecting a leak in a tension leg platform tendon, comprising:

a fluid tight, tubular tendon;

means for supplying gaseous fluid to said tendon;

means for pressurizing said gaseous fluid in excess of the maximum hydrostatic pressure exerted by the sea water on said tendon;

means for monitoring pressure, said means monitoring variations in gaseous fluid pressure in said tendon;

means for connecting an upper end of said tendon to a buoyant offshore structure;

means for connecting a lower end of said tendon to an anchor means connected to the sea floor.

2. Apparatus as recited in claim 1, wherein:

said gaseous fluid is an inert gas.

3. Apparatus as recited in claim 1, wherein:

said gaseous fluid is nitrogen.

4. Apparatus as recited in claim 1, wherein:

said gaseous fluid is air.

5. Apparatus as recited in claim 1, wherein:

said gaseous fluid is corrosion inhibiting.

6. Apparatus for detecting a leak in a tension leg platform tendon, comprising:

a buoyant offshore structure;

anchor means connected to the sea floor;

at least one tendon connected between said buoyant offshore structure and said anchor means, said tendon being a fluid tight tubular member;

means for supplying gaseous fluid to said tendon;

means for pressurizing said gaseous fluid in excess of the maximum hydrostatic pressure exerted by the sea water on said tendon; and means for monitoring pressure, said means monitoring variations in gaseous fluid pressure in said tendon.

7. Apparatus as recited in claim 6, wherein:

said gaseous fluid is an inert gas.

8. Apparatus as recited in claim 6, wherein:

said gaseous fluid is nitrogen.

9. Apparatus as recited in claim 6, wherein:

said gaseous fluid is air.

10. Apparatus as recited in claim 6, wherein:

said gaseous fluid is corrosion inhibiting.

11. A method for detecting a leak in a tension leg platform tendon, comprising the steps of:

connecting a tendon between a buoyant offshore structure and an anchor means connected to the sea floor, said tendon being a fluid tight tubular member;

supplying a gaseous fluid to said tendon;

pressurizing said gaseous fluid in excess of the maximum hydrostatic pressure exerted by the sea water on said tendon; and monitoring the gaseous fluid pressure in said tendon to detect leaks therein.

12. The method of claim 11 such that said gaseous fluid is an inert gas.

13. The method of claim 11 such that said gaseous fluid is nitrogen.

14. The method of claim 11 such that said gaseous fluid is air.

15. The method of claim 11 such that said gaseous fluid is corrosion inhibiting.

16. Apparatus as recited in claim 1 where said means for monitoring the pressure in the tendon includes means for activation of a signal to inform crew members when the tendon pressure deviates from a preset figure.

17. The method of claim 11 such that the pressure is monitored by a device that sets off a signal when the tendon pressure deviates from a preset figure.

18. The apparatus as recited in claim 1 where the tubular tendon is a load bearing tendon.

19. The apparatus as recited in claim 6 where the tendon is a load bearing tendon.

20. The method as recited in claim 11 where the tendon is a load bearing tendon.

* * * * *